US008033865B2

(12) United States Patent
Li et al.

(10) Patent No.: US 8,033,865 B2
(45) Date of Patent: Oct. 11, 2011

(54) ELECTRICAL CARD CONNECTOR

(75) Inventors: Li Li, Kunshan (CN); Fang-Yue Zhu, Kunshan (CN); Qi-Jun Zhao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/980,366

(22) Filed: Dec. 29, 2010

(65) Prior Publication Data

US 2011/0159739 A1 Jun. 30, 2011

(51) Int. Cl.
*H01R 24/00* (2011.01)

(52) U.S. Cl. ..... 439/633

(58) Field of Classification Search ..... 439/633, 439/630, 629, 631, 946
See application file for complete search history.

(56) References Cited

U.S. PATENT DOCUMENTS

| | | | | |
|---|---|---|---|---|
| 3,566,340 | A * | 2/1971 | Jayne et al. | 439/633 |
| 4,501,465 | A * | 2/1985 | Hoshino et al. | 439/633 |
| 6,805,566 | B2 * | 10/2004 | Chia-Chen | 439/188 |
| 7,004,774 | B2 * | 2/2006 | Chia-Chen | 439/188 |
| 7,326,085 | B2 * | 2/2008 | Takai et al. | 439/630 |
| 7,467,959 | B2 * | 12/2008 | Matsukawa et al. | 439/159 |
| 7,484,977 | B2 * | 2/2009 | Hsiao | 439/160 |
| 7,819,678 | B2 * | 10/2010 | Ye et al. | 439/159 |
| 7,819,684 | B2 * | 10/2010 | Fumikura | 439/326 |

* cited by examiner

*Primary Examiner* — Chandrika Prasad
(74) *Attorney, Agent, or Firm* — Wei Te Chung; Andrew C. Chang; Ming Chieh Chang

(57) ABSTRACT

An electrical card connector (100) includes an insulative housing (1), a plurality of contacts (2) retained in the insulative housing (1) for mating with an electrical card and a block (3). The insulative housing (1) defines a front mating face (14), a receiving space (10) extending backwardly from the mating face (14) and an installing wall (11) located at a rear end of the receiving space (10). The block (3) is retained in the insulative housing (1) for positioning the contacts (2). The installing wall (11) defines a through hole (111) for receiving the block (3). The block (3) has a pair of elastic segments (36) located at lateral sides thereof and a pair of slots (341) located beside the elastic segments (36) respectively for supporting elasticity of the elastic segments (36).

14 Claims, 6 Drawing Sheets

ELECTRICAL CARD CONNECTOR

BACKGROUND OF THE INVENTION

1. Field of the Invention

The present invention relates to an electrical card connector for making a plurality of contacts to be positioned in the electrical card connector steadily.

2. Description of Related Art

Usually, electrical device such as digital camera and PDA deploys an electrical card for increasing the storage of the electrical device. An electrical card connector is used for connecting the electrical card to the electrical device. The electrical card connector includes an insulative housing and a set of contacts retained in the insulative housing. The insulative housing defines a front mating face and a receiving space extending backwardly from the mating face. The contacts include a set of first and second contacts.

Each of the first contacts includes a first retaining portion retained in the insulative housing, a first contacting portion extending into the receiving space from the first retaining portion and a first soldering portion extending backwardly from the first retaining portion. Each of the second contacts includes a second retaining portion retained in the insulative housing, a second contacting portion extending into the receiving space from the second retaining portion and a second soldering portion extending backwardly from the second retaining portion. The first and second retaining portions have a number of barbs for making the contacts be fixed in the insulative housing steadily. However, the first and second contacts need to be installed on the insulative housing respectively, it will increase cost and working procedure.

Hence, an improved electrical card connector is desired to overcome the above problems.

BRIEF SUMMARY OF THE INVENTION

According to one aspect of the present invention, an electrical card connector, comprises an insulative housing, a plurality of contacts retained in the insulative housing for mating with an electrical card and a block. The insulative housing defines a front mating face, a receiving space extending backwardly from the mating face and an installing wall located at a rear end of the receiving space. The block retains in the insulative housing for positioning the contacts. The installing wall defines a through hole for receiving the block. The block has a pair of elastic segments located at lateral sides thereof and a pair of slots located beside the elastic segments respectively for supporting elasticity of the elastic segments.

According to another aspect of the present invention, an electrical card connector, comprises an insulative housing, a plurality of contacts disposed in the insulative housing with contacting portions extending into the card receiving space and a block retained in the insulative housing for positioning the contacts. The insulative housing defines a receiving space therein and an installing wall located at a rear end of the receiving space. The installing wall defines a through hole for receiving the block. The block has a pair of protrusions extending outwardly thereof and a pair of elastic segments located besides the protrusions respectively. The elastic segment brings into being distortion when the block is installed into the insulative housing. The protrusions engage with an inner wall of the installing wall which is located outside of the through hole.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1:
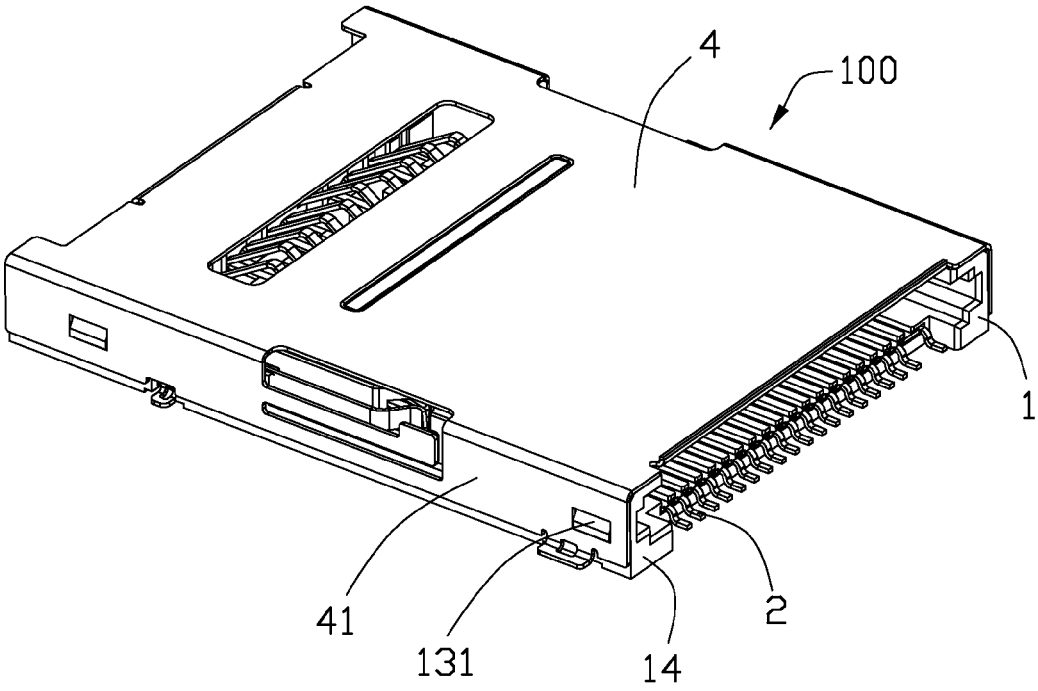
FIG. 1 is a perspective view of an electrical card connector.
Figure 2:
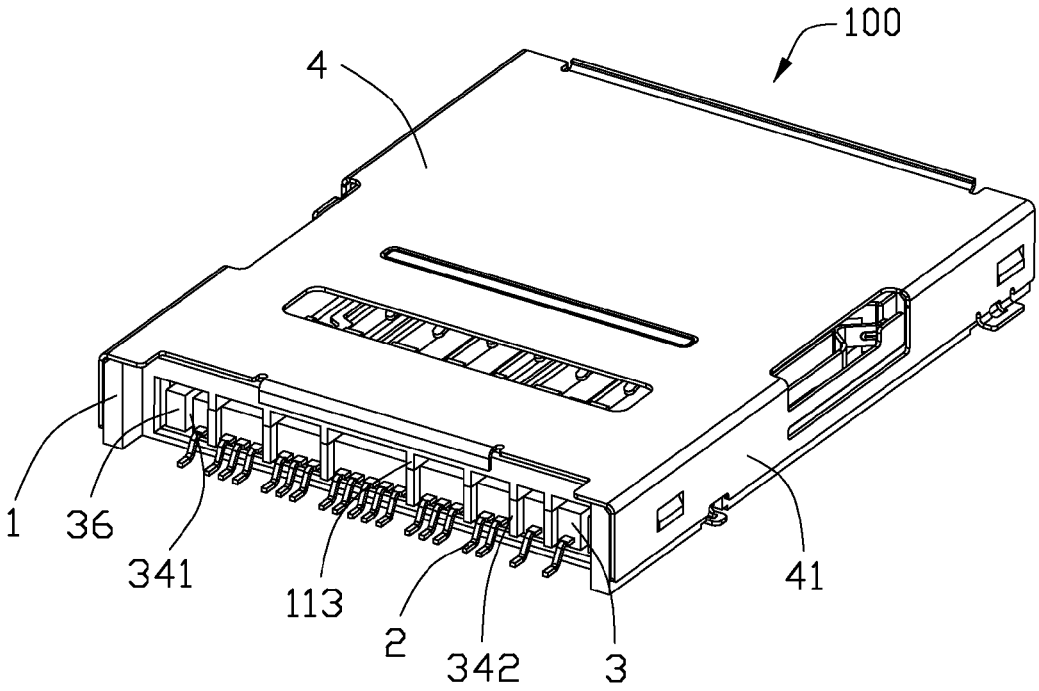
FIG. 2 is similar to FIG. 1, but viewed from another aspect.
Figure 3:
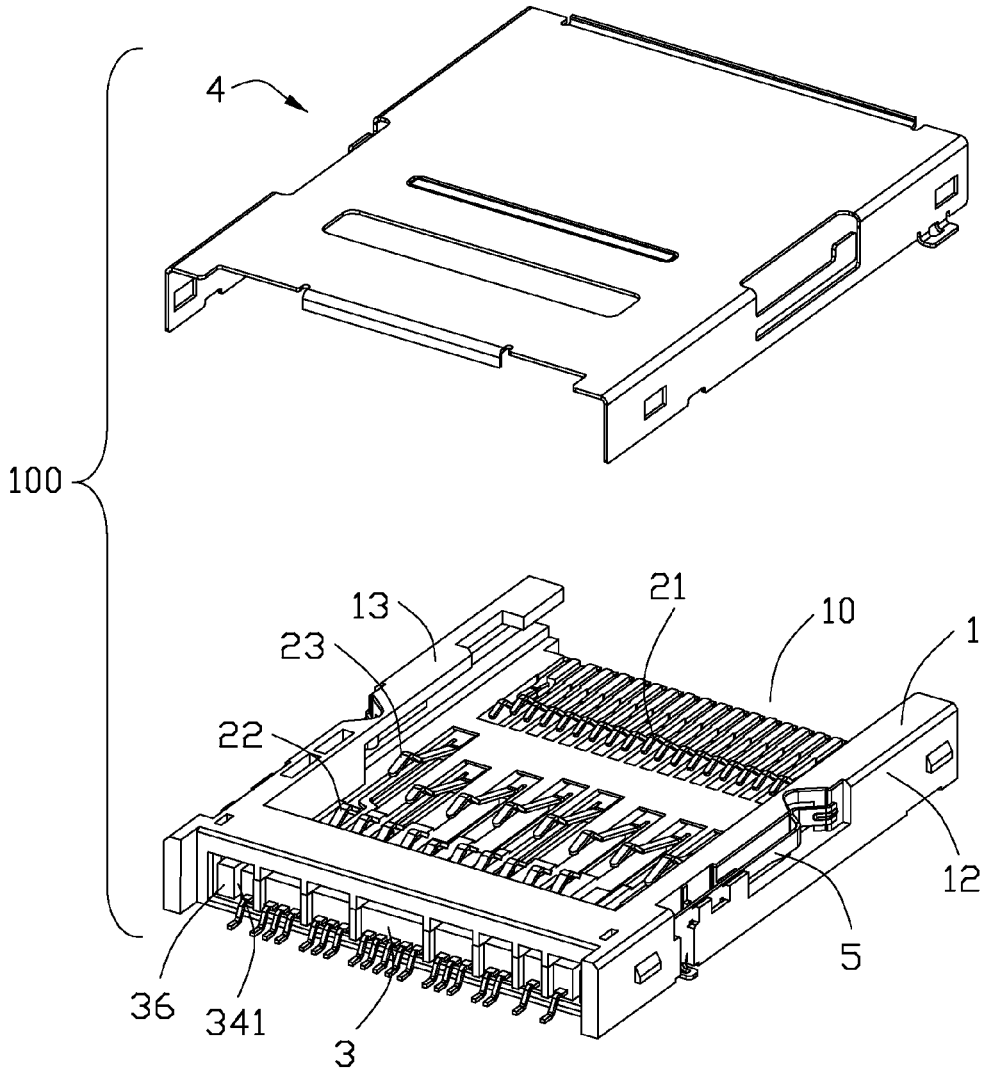
FIG. 3 is a partly exploded view of the electrical card connector shown in FIG. 1.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-6, an electrical card connector 100 for receiving four kinds of electrical cards, such as MS card、MMC card、SD card、XD card (not shown), comprises an insulative housing 1, a plurality of contacts 2 retained in the insulative housing 1, a block 3 retained in the insulative housing 1 for positioning the contacts 2, a metal shell 4 coving the insulative housing 1, a first switch 5 and a second switch 6 installed on one side of the insulative housing 1.

Figure 4:
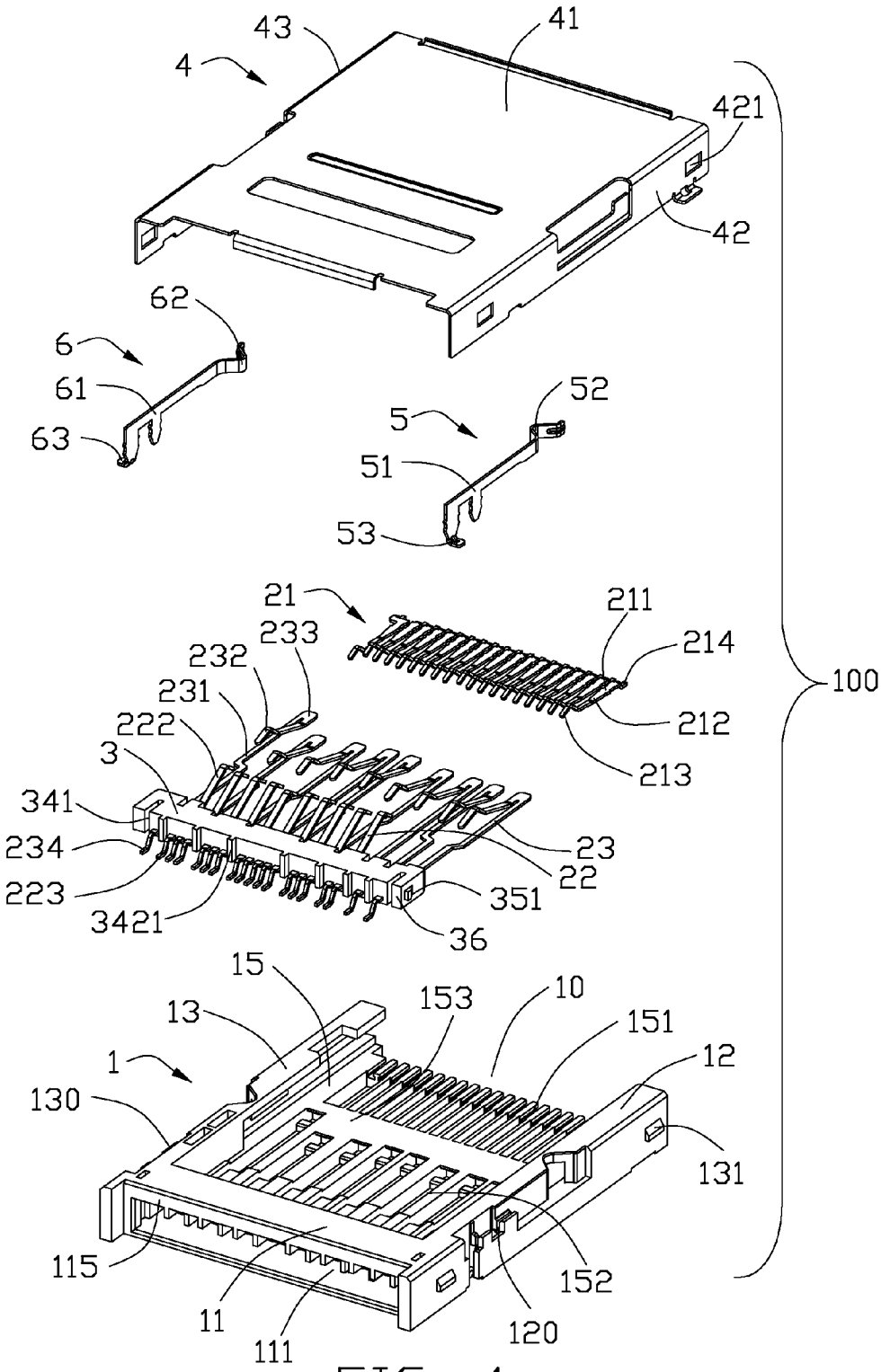
FIG. 4 is an exploded view of the electrical card connector shown in FIG. 1.

Referring to FIG. 1 and FIG. 4, the insulative housing 1 has an installing wall 11, a bottom face 15, a front mating face 14, a receiving space 10 extending backwardly from the front mating face 14 along a front to back direction for receiving the electrical card and two opposite side walls extending upwardly from two lateral sides of the bottom face 15. The side walls include a first side wall 12 and a second side wall 13. The installing wall 11 defines a through hole 111 for receiving the block 3. The through hole 111 is connected with the receiving space 10.

Figure 5:
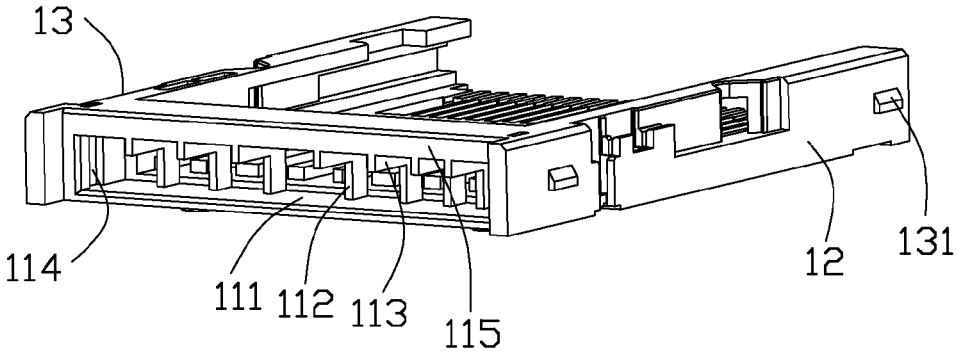
FIG. 5 is a perspective view of an insulative housing of the electrical card connector shown in FIG. 1.

Referring to FIGS. 4-5, the installing wall 11 of the insulative housing 1 includes a plurality of bars 112 extending along the front to back direction and spaced apart from each other for engaging with the block 3. Under this condition, it can prevent the block 3 from shaking along a left to right direction. The bars 112 are located at front of the through hole 111. The insulative housing 1 defines a second rear face 115. The installing wall 11 has a plurality of bulges 113 located at the top of the through hole 111 for abutting against the block 3. Therefore, it can prevent the block 3 from shaking along an up to down direction. In present embodiment, the bulges 113 are located at the top of the through hole 111, in other embodiment, the bulges 113 can be disposed at the bottom of the through hole 111. The installing wall 11 has a pair of installing holes 114 located at two lateral sides thereof and engaged with the block 3. The installing hole 114 is located close to the through hole 111.

Referring to FIGS. 4-5, the first side wall 12 defines a first assembly cavity 120 for fixing the first switch 5. The second side wall 13 defines a second assembly cavity 130 for fixing the second switch 6. The first and second side walls 12, 13 define a plurality of protuberances 131 for engaging with the metal shell 4. The bottom face 15 includes a plurality of first and second passageways 151, 152 for receiving the contacts 2 and a separating portion 153 located between the first and second passageways 151, 152.

Referring to FIG. 4, the contacts 2 are retained in the insulative housing 1 for mating with the electrical cards. The contacts 2 include a set of first contacts 21 located at front end, a set of second contacts 22 located at rear end and a set of third contacts 23 located between the first and second contacts 21, 22. The first, second and third contacts 21, 22, 23 are arranged on the insulative housing 1 along a transverse direction. Each of the first contacts 21 includes a first securing portion 211, a first extending portion 212 extending backwardly from the first securing portion 211 along the front to back direction, a first contacting portion 213 protruding from the first extending portion 212 backwardly into the receiving space 10 for connecting with the XD card and a first soldering portion 214 extending from the first securing portion 211 forwardly for soldering on a printed circuit board (not shown). The first securing portions 211 engage with a front end of the first passageways 151. The first extending portions 212 are received in the first passageways 151.

Continue to refer FIG. 4, the second and third contacts 22, 23 are integrally formed in the block 3. Under this condition, it can decrease cost and working procedure, besides, it has no inner force between the second contacts 22, the third contacts 23 and the block 3, so it prevents soldering portions of the second and third contacts 22, 23 from disconnecting with the printed circuit board. Each of the second contacts 22 includes a second securing portion (not shown) retained in the block 3, a second contacting portion 222 extending forwardly into the receiving space 10 from the second retaining portion for connecting with the MS card and a second soldering portion 223 extending backwardly from the second retaining portion for soldering on the printed circuit board.

Referring to FIG. 4, the third contacts 23 are located at front of the second contacts 22. Each of the third contacts 23 includes a third retaining portion (not shown) retained in the block 3, a third extending portion 231 extending forwardly from the third retaining portion, a third contacting portion 232 extending forwardly into the receiving space 10 from the third extending portion 231 for connecting with the SD card or MMC card, a third bending portion 233 connecting the third extending portion 231 and the third contacting portion 232 and a third soldering portion 234 extending backwardly from the third retaining portion. The third extending portions 231 are received in the second passageways 152. The bending portions 233 are abutting against a rear end of the separating portion 153. The second and third retaining portions are arranged along the left to right direction. The second and third contacting portions 222, 232 are arranged in two rows along the front to back direction.

Figure 6:
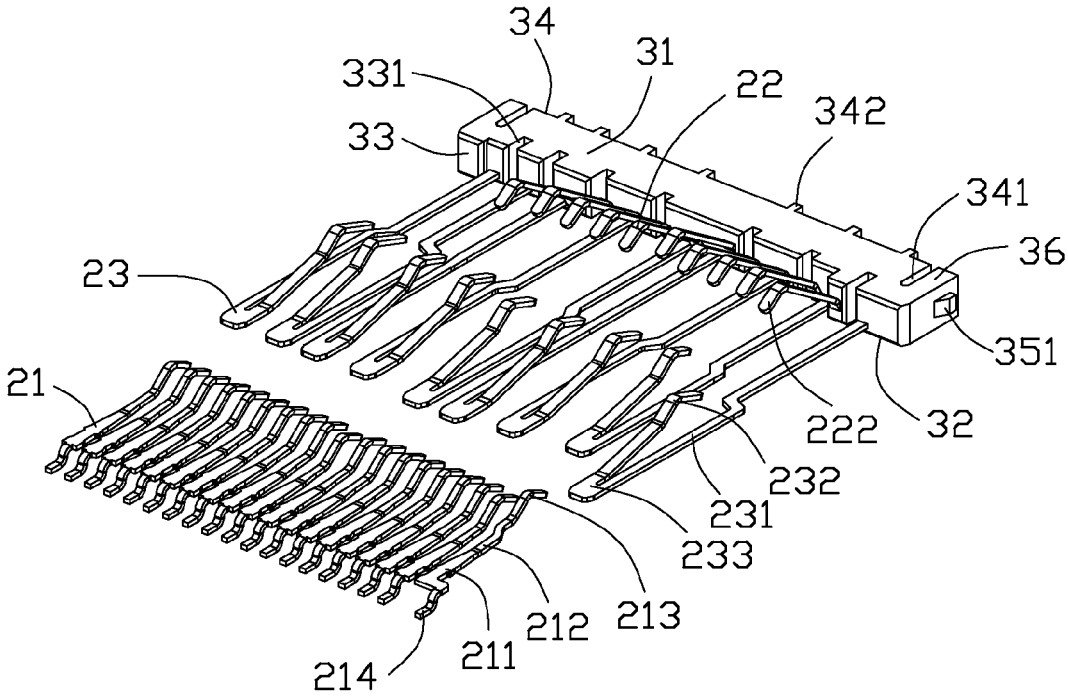
FIG. 6 is a perspective view of contacts and a block of the electrical connector shown in FIG. 1.

Referring to FIG. 6, the block 3 presents as a rectangular structure. The block 3 includes a top wall 31, a bottom wall 32, a front wall 33 and a back wall 34. The block 3 has a pair of elastic segments 36 located at lateral sides thereof and a pair of slots 341 located beside the elastic segments 36 respectively for supporting elasticity of the elastic segments 36 when the block 3 is installed into the through hole 111. Therefore, the block 3 can be positioned conveniently. The block 3 is installed on the insulative housing 1 from a back to front direction which is opposite to the front to back direction. The elastic segment 36 has distortion when the block 3 is installed into the through hole 111. The block 3 has a protrusion 351 extending outwardly therefrom and located at an outside of the elastic segments 36 respectively. The protrusions 351 engage with the installing hole 114 of the installing wall 11. Therefore, the block 3 can be positioned on the insulative housing 1 steadily.

Referring to FIGS. 4-6, the slot 341 are hollowed from the back wall 34 forwardly and is disconnected with the front wall 33. The slot 341 defines a opening facing a rear end of block 3. The front wall 33 of the block 3 includes a plurality of grooves 331 hollowed from a front end thereof backwardly and spaced apart from each other. The grooves 331 engage with the bars 112 of the installing wall 11. The back wall 34 includes a set of projections 342 extending backwardly thereof and separated with each other. Each of the projections 342 defines a first rear face 3421. The back wall 34 is located at front of the second rear face 115. The first rear face 3421 is coplanar with the second rear wall 115. By this arrangement, a part of the contacts 2 are stayed in the insulative housing 1, it facilitates the second and third soldering portions 223, 234 to be welded on the printed circuit board.

Referring to FIG. 4, the metal shell 4 is made of a piece of metal sheet, and comprises a top wall 41, a first side portion 42 and a second side portion 43. The first and second side portions 42, 43 are bended downwardly from two lateral sides of the top wall 41. The first and second side portions 42, 43 include a plurality of through slot 421 for engaging with the protuberance 131 of the insulative housing 1.

Referring to FIG. 4, the first switch 5 is installed on the first side wall 12. The first switch 5 defines a first fixing portion 51 retained in the first assembly cavity 120 of the first side wall 12, a first engaging portion 52 extending into the receiving space 10 and a first welding portion 53 extending downwardly from the first fixing portion 51. The second switch 6 defines a second fixing portion 61 retained in the second assembly cavity 130 of the second side wall 13, a second engaging portion 62 extending into the receiving space 10 from the second fixing portion 61 and a second welding portion 63 extending downwardly from the second fixing portion 61.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. An electrical card connector, comprising:

an insulative housing defining a front mating face, a receiving space extending backwardly from the mating face and an installing wall located at a rear end of the receiving space;

a plurality of contacts retained in the insulative housing; and a block retained in the insulative housing for positioning the contacts; wherein the installing wall defines a through hole for receiving the block, the block has a pair of elastic segments located at lateral sides thereof and a pair of slots located beside the elastic segments respectively to support elasticity of the elastic segments.

2. The electrical card connector as claimed in claim 1, wherein the through hole is connected with the receiving space, the block is installed on the insulative housing from a back to front direction, the elastic segment brings into being distortion when the block is installed into the through hole.

3. The electrical card connector as claimed in claim 1, wherein the block includes a protrusion extending outwardly from thereof, the installing wall has an installing hole engaged with the protrusion, the installing hole is located close to through hole.

4. The electrical card connector as claimed in claim 1, wherein the block presents as a rectangular structure, the block includes a top wall, a bottom wall, a front wall and a back wall, the slot is hollowed from the back wall forwardly and is disconnected with the front wall, the slot defines a opening facing a rear end of block.

5. The electrical card connector as claimed in claim 4, wherein the front wall of the block includes a plurality of grooves hollowed from a front end thereof backwardly and spaced apart from each other, the installing wall of the insulative housing includes a plurality of bars extending along a front to back direction and spaced apart from each other for engaging with the grooves.

6. The electrical card connector as claimed in claim 4, wherein the back wall includes a set of projections extending backwardly thereof and separated with each other, each of the projections defines a first rear face, the insulative housing defines a second rear face, the back wall is located at front of the second rear face, the first rear face is coplanar with the second rear face.

7. The electrical card connector as claimed in claim 4, wherein the installing wall has a plurality of bulges located at the top of the through hole for abutting against the block.

8. The electrical card connector as claimed in claim 1, wherein the contacts include a set of second and third contacts integrally formed in the block.

9. The electrical card connector as claimed in claim 8, wherein each of the second contacts includes a second retaining portion retained in the block, a second contacting portion extending forwardly from the second retaining portion and a second soldering portion extending backwardly from the second retaining portion, each of the third contacts includes a third retaining portion retained in the block, a third contacting portion connecting with the third retaining portion and a third soldering portion extending backwardly from the third retaining portion, the second and third retaining portions are arranged in a row along a left to right direction, the second and third contacting portions are arranged in two rows along a front to back direction.

10. An electrical card connector, comprising:

an insulative housing defining a receiving space therein and an installing wall located at a rear end of the receiving space;

a plurality of contacts disposed in the insulative housing with contacting portions extending into the card receiving space; and a block retained in the insulative housing for positioning the contacts;

wherein the installing wall defines a through hole for receiving the block, the block has a pair of protrusions extending outwardly therefrom and a pair of elastic segments located besides the protrusions respectively, the elastic segment has distortion when the block is installed into the insulative housing, the protrusions engage with an inner wall of the installing wall which is located outside of the through hole.

11. The electrical card connector as claimed in claim 10, wherein the block includes a pair of slots located at an inner side of the elastic segments respectively to support elasticity of the elastic segment.

12. The electrical card connector as claimed in claim 10, wherein the installing wall has an installing hole engaged with the protrusion.

13. The electrical card connector as claimed in claim 10, wherein the block is installed into the through hole from the back to front direction, the block includes a top wall, a bottom wall, a front wall and a back wall, the front wall of the block includes a plurality of grooves hollowed from a front end thereof backwardly and spaced apart from each other, the installing wall of the insulative housing includes a plurality of bars extending forwardly and spaced apart from each other for engaging with the grooves.

14. The electrical card connector as claimed in claim 10, wherein the contacts include a set of second and third contacts integrally formed in the block.

* * * * *